US007434371B2

(12) United States Patent
Stivani et al.

(10) Patent No.: US 7,434,371 B2
(45) Date of Patent: Oct. 14, 2008

(54) METHOD OF MAKING PRODUCT WRAPS, A LEAF FROM WHICH TO FASHION A WRAP OBTAINABLE BY THE METHOD, AND A STRIP FROM WHICH TO OBTAIN THE LEAF

(75) Inventors: Eros Stivani, Bologna (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/516,892

(22) PCT Filed: Jun. 6, 2003

(86) PCT No.: PCT/IB03/02498

§ 371 (c)(1),
(2), (4) Date: Dec. 3, 2004

(87) PCT Pub. No.: WO03/106267

PCT Pub. Date: Dec. 24, 2003

(65) Prior Publication Data

US 2005/0155329 A1 Jul. 21, 2005

(30) Foreign Application Priority Data

Jun. 18, 2002 (IT) ..... BO2002A0390

(51) Int. Cl.
*B65B 61/18* (2006.01)

(52) U.S. Cl. ..... 53/412; 53/377.4; 53/483; 229/87.05; 229/160.2; 229/904.1

(58) Field of Classification Search ..... 53/370, 53/377.4, 412, 461, 483; 229/87.05, 206; *B65D 75/12*
See application file for complete search history.

(56) References Cited

U.S. PATENT DOCUMENTS 2,079,328 A * 5/1937 McBean ..... 229/87.05

(Continued)

FOREIGN PATENT DOCUMENTS

DE 39 17 048 A1 11/1990

(Continued)

OTHER PUBLICATIONS

European Search Report dated Sep. 4, 2003.

*Primary Examiner*—Thanh K Truong
(74) *Attorney, Agent, or Firm*—Timothy J. Klima

(57) ABSTRACT

Confectionery products (2) are packaged singly in double twist wraps (1) prepared from a strip (3) coated with first longitudinal bands (4) and second transverse bands (5) of adhesive, the transverse bands spaced apart to create adhesive-free zones (6) offered in direct contact to the products (2), and caused to advance along a set path (P) in a given feed direction (D). The strip is prepared with an easy tear point (A) on each second adhesive band (5), consisting of a first notch (7) extending parallel to the longitudinal axis of the strip (3) and a second notch (8) superimposed on the first notch (7); the strip (3) is then cut transversely along the second bands (5) to generate single leaves (11), each presenting an indentation (12) and a projection (13) generated by the second notch (8). The leaf (11) is folded around the product (2) to produce a hermetically sealed wrap (1) designed to tear open from the notches.

12 Claims, 4 Drawing Sheets

U.S. PATENT DOCUMENTS

| | | | | | |
|---|---|---|---|---|---|
| 2,263,835 | A | | 11/1941 | Atkinson | |
| 2,358,246 | A | | 9/1944 | Nicolle | |
| 3,800,497 | A | * | 4/1974 | Pearson | 53/411 |
| 4,911,685 | A | | 3/1990 | Hucks | |
| 5,356,068 | A | | 10/1994 | Moreno | |
| 5,409,115 | A | * | 4/1995 | Barkhorn | 206/440 |
| 5,445,454 | A | * | 8/1995 | Barkhorn | 383/207 |
| 5,489,060 | A | * | 2/1996 | Godard | 229/87.05 |
| 5,613,779 | A | * | 3/1997 | Niwa | 383/201 |
| 5,775,063 | A | * | 7/1998 | Ikai et al. | 53/463 |
| 5,935,686 | A | * | 8/1999 | Daelmans et al. | 428/194 |
| 6,110,092 | A | | 8/2000 | Focke | |
| 6,374,583 | B1 | * | 4/2002 | Daelmans et al. | 53/483 |
| 6,748,719 | B2 | * | 6/2004 | Salicini et al. | 53/171 |
| 6,860,089 | B2 | * | 3/2005 | VanAlstine | 53/466 |

FOREIGN PATENT DOCUMENTS

| | | | | |
|---|---|---|---|---|
| DE | 40 13 918 | C2 | | 11/1991 |
| DE | 40 37 269 | A1 | | 5/1992 |
| DE | 41 09 605 | A1 | | 9/1992 |
| DE | 195 41 541 | A1 | | 5/1997 |
| DE | 198 00 509 | A1 | | 7/1999 |
| EP | 0 490 822 | A1 | | 6/1992 |
| EP | 0 490 822 | B1 | | 6/1992 |
| EP | 0816229 | | | 1/1998 |
| EP | 0957043 | | * | 11/1999 |
| GB | 666501 | | | 2/1952 |
| WO | WO 97/24273 | | | 7/1997 |

* cited by examiner

METHOD OF MAKING PRODUCT WRAPS, A LEAF FROM WHICH TO FASHION A WRAP OBTAINABLE BY THE METHOD, AND A STRIP FROM WHICH TO OBTAIN THE LEAF

This application is the National Phase of International Application PCT/IB03/02498 filed Jun. 6, 2003 which designated the U.S. and that International Application was published under PCT Article 21(2) in English.

TECHNICAL FIELD

The present invention relates to a method of making product wraps, also to a leaf used in fashioning a wrap obtainable by the method, and to a strip of material from which single leaves are obtained.

BACKGROUND ART

In particular, the invention finds application to advantage in the art field of packaging, and more specifically of fashioning individual wraps around confectionery products such as chocolates and sweets and the like.

The prior art embraces packaging methods whereby wraps of the familiar double twist type are fashioned from leaves of wrapping material, each presenting a substantially rectangular outline. The single leaves are cut transversely from a continuous strip of the selected material.

The product is placed at the centre of the leaf, and the leaf then bent around the product to bring the longitudinal edges together, thus forming a tube, whereupon the two ends of the tube are twisted to produce the characteristic wrap with two wings.

To open a wrap of this kind, the consumer seizes and pulls the two ends, causing the wings to unravel and free the contents.

The prior art also includes wraps of which the longitudinal edges and the twisted ends are coated with adhesive material, serving to seal the contents more effectively.

More exactly, and as disclosed in PCT publication WO 97/24273, these wraps are obtained by applying two continuous bands of adhesive material to the edges of the continuous strip, extending longitudinally along its entire length. In addition, the strip presents a plurality of bands of the adhesive material extending transversely to the longitudinal dimension and spaced apart one from the next. The strip is cut along each transverse band of adhesive material to generate a plurality of single leaves, each presenting bands of adhesive material around its peripheral outline.

The product is then wrapped by joining together the bands of adhesive along the longitudinal edges and twisting the ends in such a way as to pinch the transverse bands of adhesive. Thus, the adhesive bands provide a tighter seal and a firmer closure of the product internally of the wrap.

A wrap of this type betrays the notable drawback of being difficult to open in order to consume the product. Formerly, without adhesive, the wrap could be opened by pulling the twisted ends in opposite directions, but with the wings pinched and stuck, they can no longer unravel freely as before.

To overcome this drawback, the joined longitudinal edges of double twist wrapper leaves can be provided with a notch (see EP 816229, for example) serving to facilitate the step of opening the wrap. Pulling from the edges on either side of the notch, the wrap is torn along a line generated by the selfsame notch.

The notch is produced in the assembled wrap by a special device (generally a wheel) that carries each of the single wraps into a position of interaction with a cutter, whereupon the cutter makes an incision in the joined longitudinal edges.

This solution also presents a significant drawback, however, attributable to the excessive bulk of the notching device.

To make a single notch, in effect, the longitudinal edges must be cut when already joined together, and this can be done only by conveying each single wrap into contact with the cutter after it has been closed around the product. Generally speaking, the notching device consists in a wheel carrying a plurality of grippers by which the assembled wraps are taken up and advanced toward the cutter. The wheel takes up considerable space and the process of fashioning the single wraps is made complex and laborious precisely by reason of the need to carry each one toward the notching cutter. Consequently, the cost of producing the single wrap is increased.

Moreover, in the event that the longitudinal edges are not joined neatly together, the cutter can enter into contact with the product and tear parts of the wrap intended specifically to keep the product enclosed.

The object of the present invention is to overcome the drawbacks indicated above by adopting a method of making wraps for small items, a leaf from which to fashion the wrap obtainable by such a method, and a relative strip of wrapping material, all as described and illustrated in the present disclosure.

In particular, it is an object of the invention to provide a method of making product wraps that will be easy to implement and can be performed without the need for complex and bulky wrapping devices.

A further object of the invention is to fashion an easily openable sealed wrap procured initially as a leaf of wrapping material cut from a continuous strip and requiring no additional preparation.

DISCLOSURE OF THE INVENTION

The stated object is realized according to the present invention in a method of making product wraps comprising the steps of: causing a continuous strip of wrapping material, presenting at least two bands of adhesive extending parallel with its longitudinal dimension, to advance along a predetermined path; cutting the strip transversely along dividing lines to obtain a plurality of leaves each presenting longitudinal edges coinciding with relative dividing lines; associating at least one product with a respective substantially central area of each leaf; folding each leaf around a relative product and bringing together the two longitudinal edges to form a tubular sheath; closing the ends of the tubular sheath to obtain a wrap, characterized in that it comprises a step, preceding the step of folding each leaf around a relative product, of establishing at least one point between the two adhesive bands and coinciding with the transverse dividing line, from which to initiate an easy tear along a direction substantially transverse to the longitudinal edges of the leaf.

The stated object is realized likewise, according to the present invention, by providing a strip of material from which to fashion product wraps, of the type comprising: a pair of first adhesive bands extending parallel to the longitudinal edges of the strip; also a predetermined number of second adhesive bands extending transversely to the longitudinal dimension of the strip and spaced apart one from the next, wherein the first and second adhesive bands define a plurality of product placement zones each compassed between one second band and the next, characterized in that it comprises at least one notch located to coincide with each second adhesive band.

Lastly, the stated object is realized in a leaf of wrapping material according to the present invention from which to fashion a product wrap, as obtainable in particular by the method according to any one of the appended claims, comprising: a top face presenting a substantially rectangular peripheral outline; a pair of first adhesive bands extending along the mutually opposed and parallel shorter sides of the peripheral outline presented by the top face; a pair of second adhesive bands extending along the mutually opposed and parallel longer sides of the peripheral outline presented by the top face; a placement zone delimited by the pairs of first and second bands in which to position at least one product; and a first notch located along each second adhesive band and extending parallel to the first adhesive bands, characterized in that it further comprises at least one second notch establishing an indentation located on a respective second adhesive band and presenting the first notch.

The invention will now be described in detail, by way of example, with the aid of the accompanying drawings, in which:

FIG. 1 is the plan view of a strip of wrapping material illustrated in a first embodiment according to the present invention;

FIG. 1*a* is the plan view of a strip of wrapping material illustrated in a variation on the first embodiment shown in FIG. 1;

With reference to the drawings, 1 denotes a wrap, in its entirety, for products 2 of small dimensions, particularly items of confectionery such as toffees, chocolates and the like.

Figure 1:
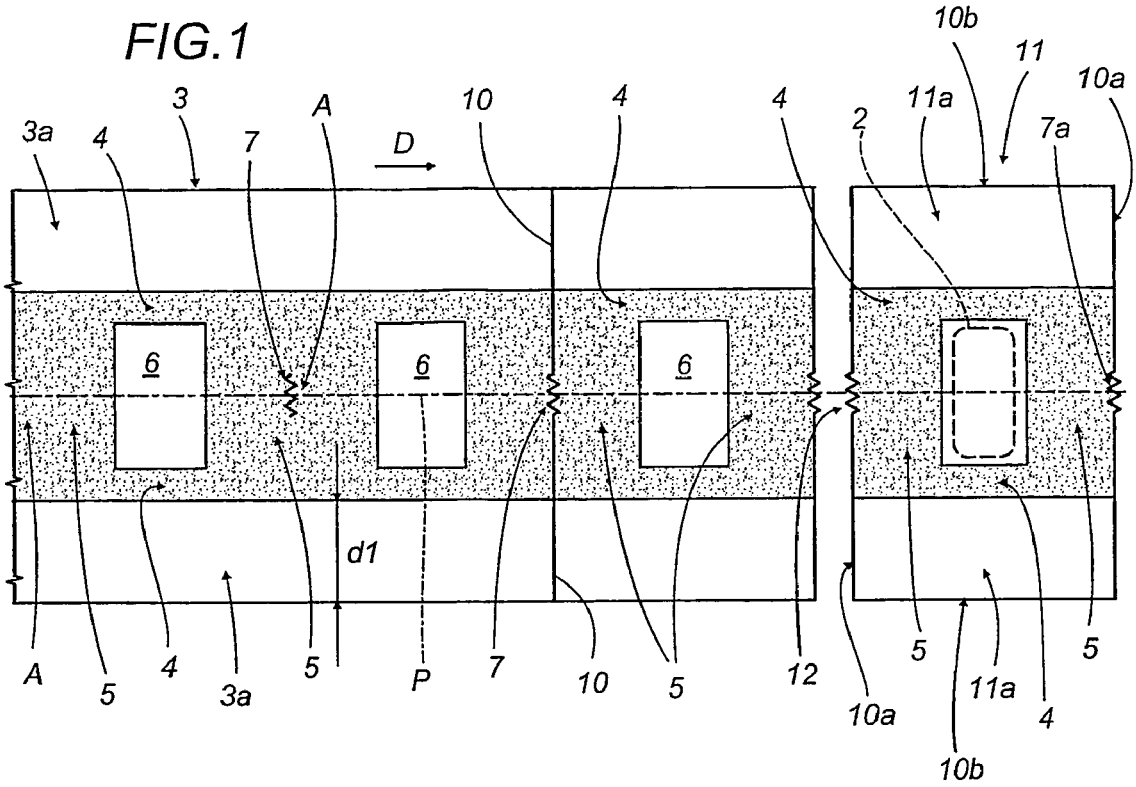

Referring in particular to FIG. 1, the wrap 1 is obtained from a strip 3 of wrapping material caused to advance by means of conventional embodiment (not illustrated) along a predetermined path P and in a predetermined direction D.

The strip 3 presents two first adhesive bands 4, extending parallel with the longitudinal dimension of the strip 3 in positions on either side of its longitudinal axis. More exactly, the first bands 4 in question are located near to the two longitudinal edges 3*a* of the strip 3, and separated from the selfsame edges 3*a* by a predetermined distance d1 for reasons that will become clear in due course.

The first bands 4 extend continuously along the entire developable length of the strip 3 and will consist of any given material applicable in liquid or solid form and able to produce an adhesive surface, such as one of the cold glues widely used in the packaging sector.

The strip 3 also presents a predetermined number of second adhesive bands 5 extending transversely to the longitudinal dimension of the strip 3.

More particularly, the second adhesive bands 5 are spaced apart so as to establish a placement zone 6 between one band 5 and the next, in which to position the product 2. In practice, each placement zone 6 interposed between two successive second bands 5 will present a substantially rectangular outline of which the longer sides coincide with the selfsame second bands 5 and the shorter sides coincide with the first adhesive bands 4, thereby creating an adhesive-free zone 6 offered in contact to the product 2.

Each of the second adhesive bands 5 will coincide also with an easy tear point A, at which at least one first notch 7 is made.

The strip 3 is cut crosswise along successive transverse dividing lines 10, each coinciding with a second adhesive band 5 and with the relative easy tear point A, to generate a plurality of leaves 11.

In the example of FIG. 1, the notch 7 extends along a middle portion of the dividing line 10 and consists in a segment 7*a* of broken line appearance, in this instance presenting a zigzag profile.

Figure 1A:
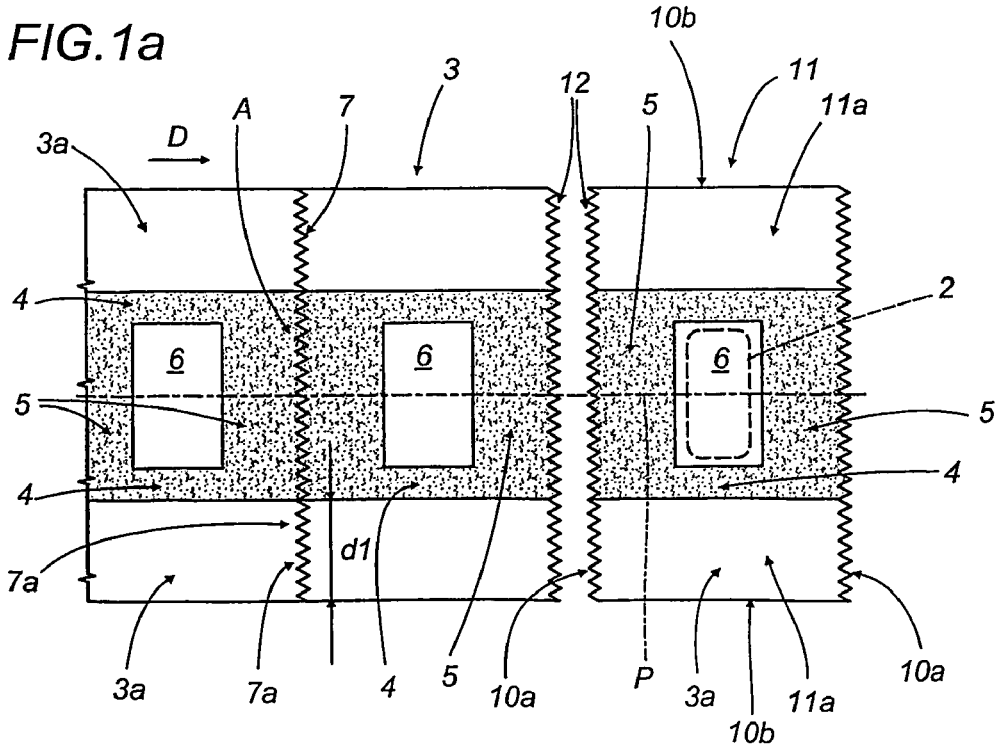

In the example of FIG. 1*a*, the segment 7*a* extends along the full length of the dividing line 10.

Figure 2:
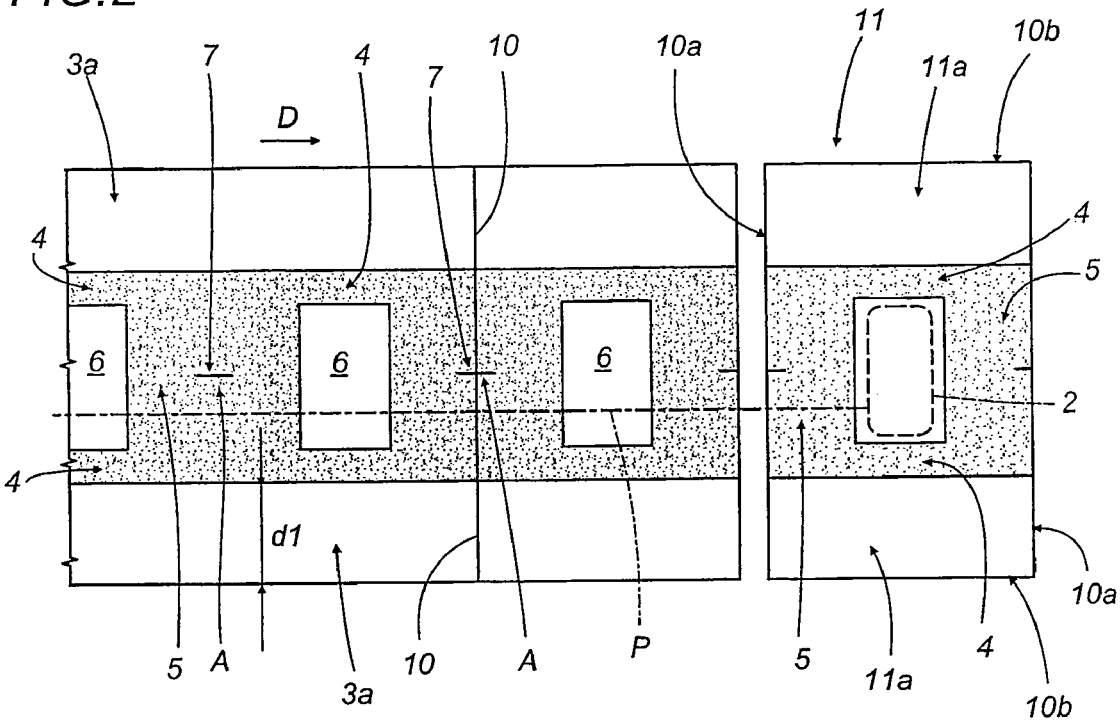
FIG. 2 is the plan view of a strip of wrapping material illustrated in a second embodiment.

In the second embodiment illustrated in FIG. 2, the first notch 7 is substantially rectilinear and extends parallel to the longitudinal dimension of the strip 3. The notch 7 is produced by a suitably shaped cutter, conventional in embodiment and therefore not described or illustrated further. If the notch were to be produced with the strip advancing continuously, for example, the cutter could be carried by the peripheral surface of a roller interacting with a reaction roller positioned on the opposite side of the path P from the cutter roller; in this instance the cutter or cutters will be timed or spaced on the revolving surface so as to strike at a predetermined frequency corresponding to the distance separating two successive notches 7 presented by the strip 3.

Figure 3:
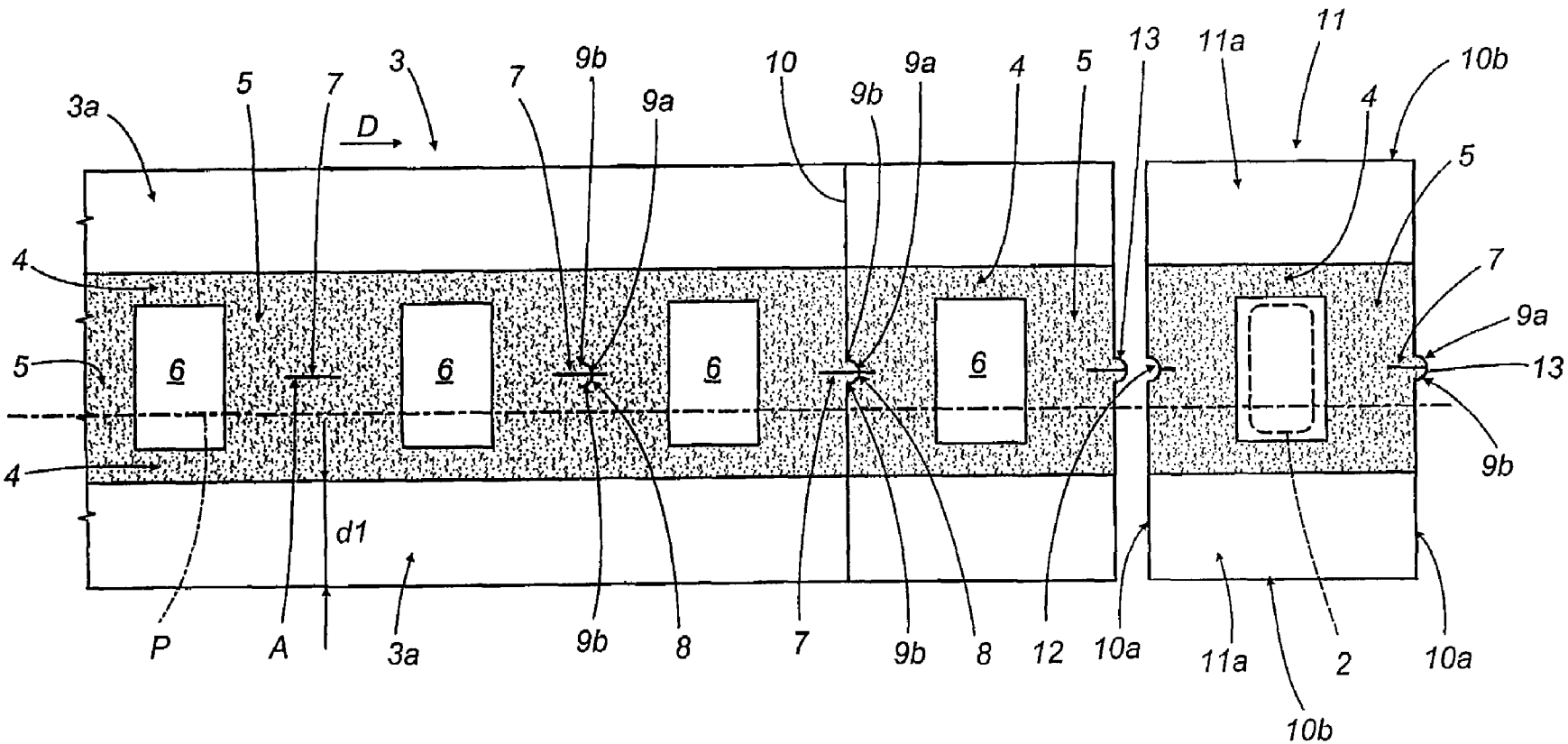
FIG. 3 is the plan view of a strip of wrapping material illustrated in a third embodiment.
Figure 4:
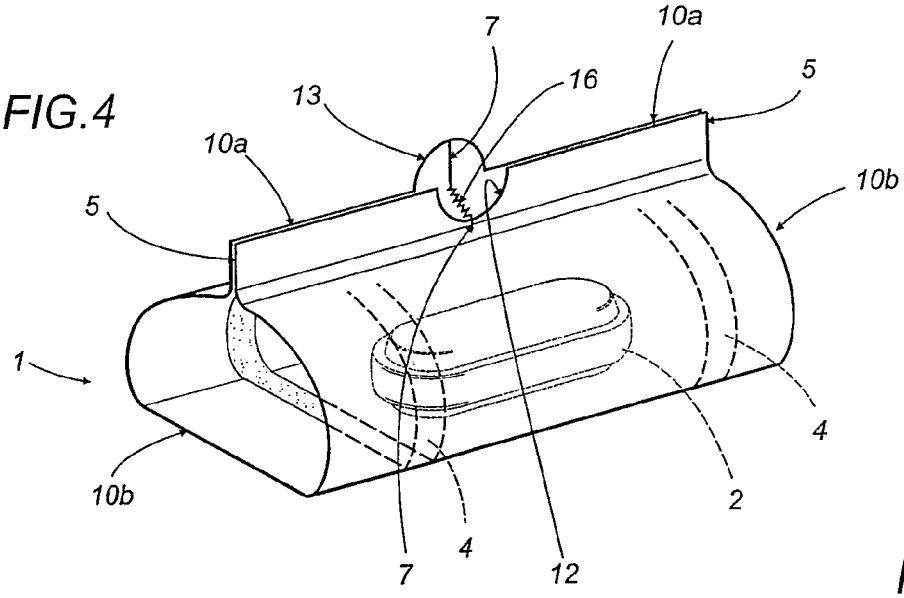
FIG. 4 is the perspective view of a product wrap obtained from the strip of FIG. 3.

With reference to FIGS. 3 and 4, which illustrate the third embodiment disclosed, this also presents a second notch 8 (produced likewise using a cutter able to interact with the strip 3 in the manner described above), by which the first notch 7 is intersected transversely. The second notch 8 illustrated in FIG. 3 presents a substantially "U" shaped outline and consists in practice of a central, substantially semicircular segment 9*a* extending transversely across the first notch 7, and two substantially rectilinear segments 9*b* merged with the respective ends of the central segment 9*a*.

The second notch 8 could equally well present a "Vee" or a substantially "W" or "S" shape, and will be positioned in any event to coincide with the dividing line 10.

Each leaf 11 obtained by cutting the strip 3 along the dividing lines 10 will present two longitudinal edges 10*a* generated by the transverse cut. In other words, the dividing lines 10 extend transversely to the strip 3, while establishing the longitudinal edges 10*a* of the single leaf 11.

In more detail, each leaf 11 presents a substantially rectangular face 11*a* offered in direct contact to the relative product 2, the aforementioned placement area 6 being positioned at the centre of this same face 11*a*. The single leaf 11 thus appears with the second adhesive bands 5 extending parallel to the edges 10*a* constituting the longer sides of the leaf 11, and the first adhesive bands 4 extending parallel to the remaining edges denoted 10*b* which coincide with the shorter sides.

In the examples of FIGS. 1 and 3, the transverse cut made across the continuous strip 3, along the dividing line 10, is interrupted at the easy tear point A so as not to interfere with the first and second notches 7 and 8. In practice, therefore, the transverse cut made along the dividing line 10 consists effectively in two distinct cuts, each extending from a respective rectilinear segment 9*b* to a corresponding longitudinal edge 3*a* of the strip 3.

In particular, the second notch 8 is cut in such a manner as to create an indentation 12 in one leaf 11 and a projection 13 on the adjacent leaf 11, the shape of the projection 13 matching the shape of the indentation 12.

Thus, each leaf 11 presents an indentation 12 on one of the two second adhesive bands 5, and a projection 13 on the second adhesive band 5 opposite. It will be seen that, in making the transverse cut across the strip 3, the first notch 7 is divided into two parts, each constituting a respective part of the projection 13 and of the indentation 12.

Figure 5:
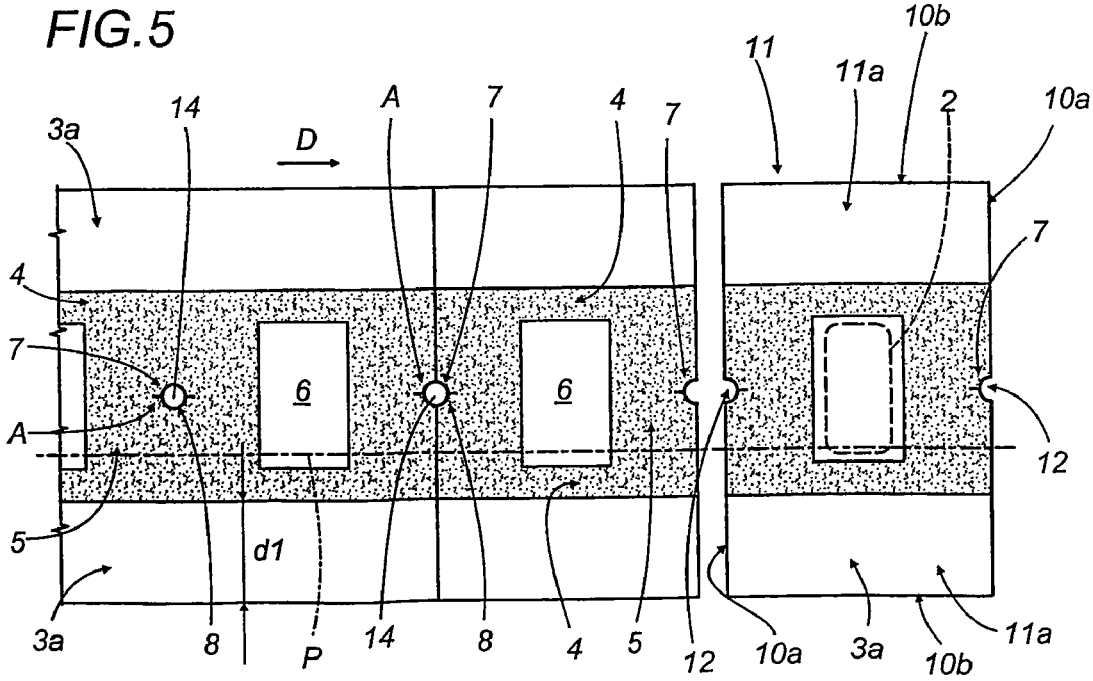
FIG. 5 is the plan view of a strip of wrapping material illustrated in a fourth embodiment.
Figure 6:
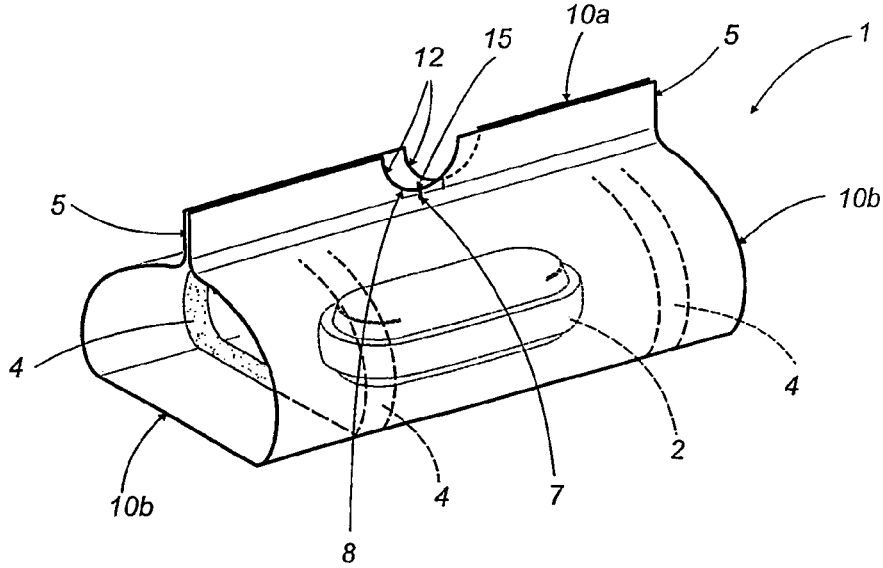
FIG. 6 is the perspective view of a product wrap obtained from the strip of FIG. 5.

In the fourth embodiment of the wrap, illustrated in FIGS. 5 and 6, the second notch 8 consists in a hole 14 (pierced by a cutter of circular cross section) superimposed on the first notch 7. In this instance, the transverse cut across the strip 3 can be made along the dividing line 10 in a single stroke, with no need for any break at the easy tear point A.

The leaf 11 thus presents two mutually opposed indentations 12, each coinciding with a respective second adhesive band 5 and each also presenting a first notch 7.

Significantly, the second notch 8 can be cut together with the first notch 7, either before or simultaneously with the step of cutting the strip 3 transversely. In any event, the indentations 12 and projections 13 are made directly in the continuous strip 3, rather than in the assembled wrap 1.

To fashion the wrap 1 illustrated in FIG. 4, the product 2 is positioned in the placement zone 6 of a corresponding leaf 11 of wrapping material, and the leaf then gathered initially around the product 2 to form a tubular sheath, with the two second adhesive bands 5 joined together. More exactly, the longer sides of the leaf 11 are joined with the respective second adhesive bands 5 offered one to the other along the corresponding edges 10*a*, with the result that the two bands 5 are stuck together. Observing FIG. 4, it will be seen that the positions of the projection 13 and the indentation 12 coincide, albeit the two are marginally offset one from the other. This is how the wrap will appear in reality, as a result of the two edges 10*a* of the leaf 11 shifting one relative to the other when formed into a tube around the product 2.

Likewise in FIG. 6, which illustrates the fourth embodiment of the wrap, the two indentations 12 are substantially aligned, yet slightly offset one from another.

Once the tubular sheath has been formed, the two open end portions presenting the two first adhesive bands 4 are twisted to form two wings 15, thereby pinching the leaf along the respective bands 4 and sealing the wrap 1 hermetically.

Figure 7:
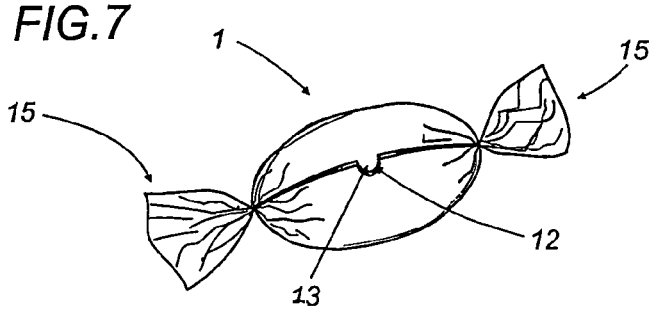
FIG. 7 is the perspective view of a product wrap obtained from the strip of FIG. 5 and containing, in particular, an item of confectionery.

Referring to FIG. 7, the wrap 1 containing a relative product 2 is opened simply by pulling on the projection 13 or the indentations 12.

More exactly, and referring to the third embodiment of FIG. 4, the effect of pulling the projection 13 is that the first notch 7 will initiate a tear to separate the two edges of the projection 13. Once the tear has opened along the full length of the projection 13, along a line denoted 16, it will continue into the first notch 7 presented by the indentation 12. At this point, both the edges of the leaf 11 bearing the second adhesive bands 5 will have been torn through and separated, and the wrap 1 can be opened up with notable ease.

In the case of the fourth embodiment, the method of opening the wrap 1 is the same as described above. In this instance the pulling force will be applied first to one of the two indentations 12, then continued until the tear extends through both of the two first notches 7 afforded by the respective indentations 12.

The present invention affords numerous advantages.

Firstly, the method of manufacturing the single wrap 1 is extremely simple and does not call for the use of cumbersome cutting mechanisms, neither for any special handling and conveying of the wrap 1 after being closed. In effect, the first notch 7 of the easy tear feature is applied directly to the strip 3 before fashioning the wrap.

In addition, there is no need for the second adhesive bands 5 to be joined so that the first notches 7 are perfectly matched, given that with the addition of the second notch 8 establishing the indentation 12, a tear can be made through both edges of the wrap 1 without difficulty.

Furthermore, the effect of forming the notches 7 and 8 directly in the strip 3 is to speed up the operation of assembling the wrap 1, since there is no need for any further processing steps once the wrap has been closed, and no requirement for an especially precise alignment between the first notches 7 on each of the second adhesive bands 5.

The invention claimed is:

1. A method of making product wraps, comprising the steps of:

causing a continuous strip of wrapping material, having at least two first adhesive bands extending parallel with its longitudinal dimension, to advance along a predetermined path, the strip also having second adhesive bands extending transversely to the longitudinal dimension of the strip;

cutting the strip transversely along dividing lines to obtain a plurality of leaves each having longitudinal edges coinciding with relative dividing lines, the dividing lines also separating the second adhesive bands;

establishing at least one portion between the two first adhesive bands and coinciding with each transverse dividing line from which to initiate an easy tear along a direction substantially transverse to the longitudinal edges of the leaf, generating, on each easy tear portion, at least one first notch on each dividing line, extending parallel to the longitudinal dimension of the strip and intersecting the dividing line, generating a second notch, establishing at least one indentation, intersecting transversely each first notch; the second notch coinciding with the dividing line to create a projection on an opposite longitudinal edge of each leaf that projects beyond the dividing line, the projection being divided into two transverse portions by the first notch which longitudinally extends along the projection itself, the first notch being limited in length so as not to extend longitudinally beyond the respective second adhesive bands and thereby intrude in a substantially centrally located product placement zone positioned between the second adhesive bands and the first adhesive bands of each leaf;

associating at least one product with the respective product placement zone of each leaf;

folding each leaf around the at least one product and bringing together the two longitudinal edges to adhere the second adhesive bands and form a tubular sheath;

closing the ends of the tubular sheath to adhere the first adhesive bands and obtain a wrap around the product.

2. A method as in claim 1, wherein the first notch and the second notch are generated prior to the step of cutting the strip transversely along the dividing lines.

3. A method as in claim 1, wherein the first notch and the second notch are generated simultaneously with the step of cutting the strip transversely along the dividing lines.

4. A method as in claim 1, wherein the steps of generating the first notch, generating the second notch and cutting the strip transversely along the dividing lines are implemented in sequence.

5. A method as in claim 1, wherein the second notch presents an outline substantially of one of a "U" shape, a "Vee" shape, a "W" shape, or an "S" shape.

6. A method as in claim 1, wherein the step of generating a second notch comprises the subsidiary step of piercing the easy tear portion in such a way as to create two indentations in each leaf, each presented by a respective longitudinal edge.

7. A method as in claim 1, wherein the step of cutting the strip transversely along the dividing line comprises the subsidiary steps of making two distinct cuts along the selfsame line, each extending from the second notch toward a longitudinal edge of the strip.

8. A method as in claim 1, wherein the step of generating at least one first notch parallel to the longitudinal dimension of the strip is implemented before the step of cutting the strip transversely along the dividing line.

9. A method as in claim 1, wherein the step of establishing an easy tear portion comprises the step of generating at least one segment of broken line appearance positioned to coincide with the transverse dividing line.

10. A method as in claim 1, wherein the broken line segment extends the full length of the transverse cut made across the strip.

11. A method as in claim 1, comprising the step of twisting the ends of the tubular sheath to produce a sealed double twist wrap.

12. A method as in claim 1, comprising the step, implemented as the strip advances along the predetermined direction and before the step of generating the notches, of applying the first and second adhesive bands to the selfsame strip.

* * * * *